US007267159B2

(12) United States Patent
Iwasaki et al.

(10) Patent No.: US 7,267,159 B2
(45) Date of Patent: Sep. 11, 2007

(54) COUNTERFLOW HEAT EXCHANGER

(75) Inventors: Mitsuru Iwasaki, Nakano-ku (JP); Kazunori Namai, Nakano-ku (JP)

(73) Assignee: Calsonic Kansei Corporation, Tokyo (JP)

( * ) Notice: Subject to any disclaimer, the term of this patent is extended or adjusted under 35 U.S.C. 154(b) by 0 days.

(21) Appl. No.: 10/575,892

(22) PCT Filed: Oct. 13, 2004

(86) PCT No.: PCT/JP2004/015052

§ 371 (c)(1),
(2), (4) Date: Apr. 14, 2006

(87) PCT Pub. No.: WO2005/038380

PCT Pub. Date: Apr. 28, 2005

(65) Prior Publication Data

US 2007/0017657 A1 Jan. 25, 2007

(30) Foreign Application Priority Data

Oct. 16, 2003 (JP) ..... 2003-356833

(51) Int. Cl.
*F28F 7/00* (2006.01)
*F28D 7/06* (2006.01)

(52) U.S. Cl. ..... 165/67; 165/176; 165/69

(58) Field of Classification Search ..... 165/67, 165/140, 144, 153, 176, 69; 180/68.4
See application file for complete search history.

(56) References Cited

U.S. PATENT DOCUMENTS

| | | | | |
|---|---|---|---|---|
| 5,314,013 | A * | 5/1994 | Tanabe | 165/176 |
| 5,348,081 | A * | 9/1994 | Halstead et al. | 165/144 |
| 5,355,941 | A * | 10/1994 | Blankenberger et al. | 165/67 |
| 6,199,401 | B1 * | 3/2001 | Haussmann | 62/525 |
| 6,237,680 | B1 * | 5/2001 | Davis | 165/176 |
| 6,536,517 | B2 * | 3/2003 | Hoshino et al. | 165/176 |
| 6,612,387 | B2 * | 9/2003 | Guyomard et al. | 180/68.4 |
| 6,672,416 | B1 * | 1/2004 | Guyomard et al. | 180/68.4 |
| 6,745,827 | B2 * | 6/2004 | Lee et al. | 165/144 |

FOREIGN PATENT DOCUMENTS

| | | |
|---|---|---|
| JP | 04-187990 A | 7/1992 |
| JP | 08-178556 A | 7/1996 |

* cited by examiner

*Primary Examiner*—Tho Duong
(74) *Attorney, Agent, or Firm*—Foley & Lardner LLP

(57) ABSTRACT

A countercurrent heat exchanger includes a pair of heat exchanger cores (1, 2) with multiple tubes (11, 21) and fins (12, 22) which are arranged alternatively and next to each other in its depth direction. One end sides of the tubes (11, 21) of the inflow-side heat exchanger core (1) and the outflow-side heat exchanger core (2) is connected with a U-turn intermediate tank (3), and the other end sides are connected with the inflow-side tank (4) and the outflow-side tank (5) which are separated from each other. The inflow-side tank (4), outflow-side tank (5) and intermediate tank (3) are attached to a vehicle body side so that the heat exchanger cores (1) and (2) can expand and contract with respect to the intermediate tank (3).

11 Claims, 5 Drawing Sheets

COUNTERFLOW HEAT EXCHANGER

TECHNICAL FIELD

The present invention relates to a countercurrent heat exchanger, in which a pair of heat exchanger cores are arranged next to each other in their depth directions and coolant can flow from one of the heat exchanger cores to the other of the heat exchanger cores, turning around in an intermediate tank connected with them.

DESCRIPTION OF THE RELATED ART

A conventional countercurrent heat exchanger of this kind is disclosed in Japanese Patent Application Laid-open No. Tokkai 2002-393498. This countercurrent heat exchanger includes a pair of heat exchanger cores each having multiple tubes and fins arranged alternately and next to each other in its depth direction, an inflow-side tank connected with one end sides of the tubes contained in one of the heat exchanger cores, an outflow-side tank connected with one end sides of the tubes contained in the other of the heat exchanger cores, and a U-turn intermediate tank connected with the other end sides of the tubes for turning around coolant. The inflow-side tank and the outflow-side tank are integrally formed with each other, being separated by a separation wall between them to split off their coolant passages.

However, the above-described countercurrent heat exchanger has the following problems, because he inflow-side tank and the outflow-side tank are constructed integrally with each other so that they are separated by only the separation wall provided between them.

In a construction where the inflow-side tank and the outflow-side tank are integrally formed with each other, large thermal stress applies to the tubes, the inflow-side tank, the outflow-side tank and others, and might causes a strain, a crack, destruction and/or the like due to a thermal expansion difference caused between the both heat exchanger cores, since a thermal difference becomes large, approximately 40° C., between the coolant flowing in an inflow-side tank connected portion of the heat exchanger core and the coolant flowing in an outflow-side tank connected portion of the heat exchanger core.

Further, high temperature coolant flowing in the inflow-side tank transfers its heat to the coolant flowing in the outflow-side tank through the separation wall to heat it up, since the inflow-side tank and the outflow-side tank are separated by only one separation wall. This decreases heat transfer efficiency of the heat exchanger cores.

[PATENT REFERENCE 1] Japanese Patent Application Laid-open No. Tokkai 2002-393498

DESCRIPTION OF THE INVENTION

PROBLEM(S) TO BE SOLVED BY THE INVENTION

An object of the present invention is to provide a countercurrent heat exchanger that can avoid occurrence of a strain, a crack, destruction and the like in any part of the countercurrent heat exchanger due to heat stress caused by a temperature difference between coolants flowing in heat exchanger cores and also increase its heat transfer efficiency.

In order to accomplish the object, a countercurrent heat exchanger of the present invention is constructed so that it comprises a pair of heat exchanger cores having multiple tubes and fins which are arranged alternatively, the heat changer cores being arranged next to each other in depth directions thereof: a U-turn intermediate tank connected with one end sides of the tubes contained in the heat exchanger cores; an inflow-side tank connected with the other end sides of the tubes contained in one of the heat exchanger cores; and an outflow-side tank formed to be separated from the inflow-side tank, the outflow-side tank being connected with the other end sides of the tubes contained in the other of the heat exchanger cores, wherein the inflow-side tank, the outflow-side tank and the intermediate tank are attached to a vehicle body side so that the both heat exchanger cores can expand and contract independently from each other with respect to the intermediate tank.

EFFECTS OF THE INVENTION

In the countercurrent heat exchanger of the present invention, it provides an effect on avoiding a strain, a crack, destruction and the like in its parts due to thermal stress caused by a temperature difference between the coolants flowing in the both heat exchanger cores, since the inflow-side tank, the outflow-side tank and the intermediate tank are attached rotatably to the vehicle body member so that the heat exchanger cores can expand and contract independently from each other with respect to the intermediate tank.

In addition, the countercurrent heat exchanger of the present invention provides another effect on increasing the heat transfer efficiency, because it is constructed to have the inflow-side tank and the outflow-side tank which are formed separately from each other, so that heat of the coolant is prevented from being transferred from the inflow-side tank to the outflow-side tank.

DESCRIPTION OF REFERENCE NUMBER

Figure 1:
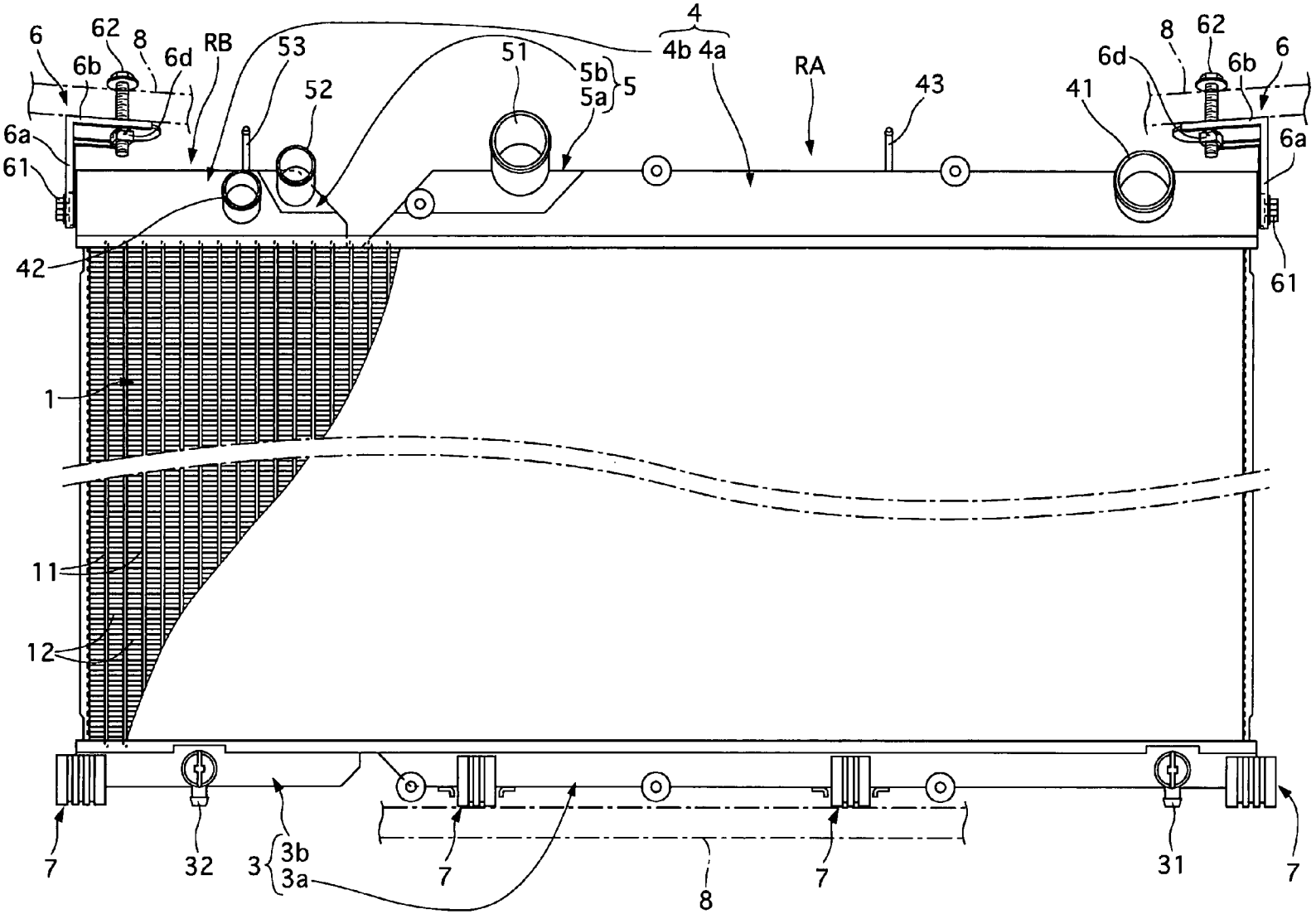
FIG. 1 is a partially-sectional front view showing a countercurrent heat exchanger of an embodiment according to the present invention.

RA radiator with engine coolant (a first radiator)
RB radiator with electric system coolant (a second radiator)
1 inflow-side heat exchanger core
11 tubes
12 fins
2 outflow-side heat exchanger core
21 tubes
22 fins
3 U-turn intermediate tank
3*a* intermediate tank for the first radiator
3*b* intermediate tank for the second radiator
31 drain pipe
32 drain pipe
4 inflow-side tank
4*a* inflow-side tank for the first radiator
4*b* inflow-side tank for the second radiator

41 inflow pipe
42 inflow pipe
43 air-bleeding pipe
5 outflow-side tank
5*a* outflow-side tank for the first radiator
5*b* outflow-side tank for the second radiator
51 outflow pipe
52 outflow pipe
53 air-bleeding pipe
6 bracket
6*a* heat-exchanger-side attachment portion
6*b* vehicle-body-side attachment portion.
6*c* bolt hole
6*d* welded nut
61 bolt
7 rubber bush (an elastically supporting member)
8 radiator core support (a vehicle-body-side member)
8*a* elongate hole

BEST MODE FOR CARRYING-OUT OF THE INVENTION

Hereinafter, an embodiment of the present invention will be described with reference to the accompanying drawings.

EMBODIMENT

Figure 2:
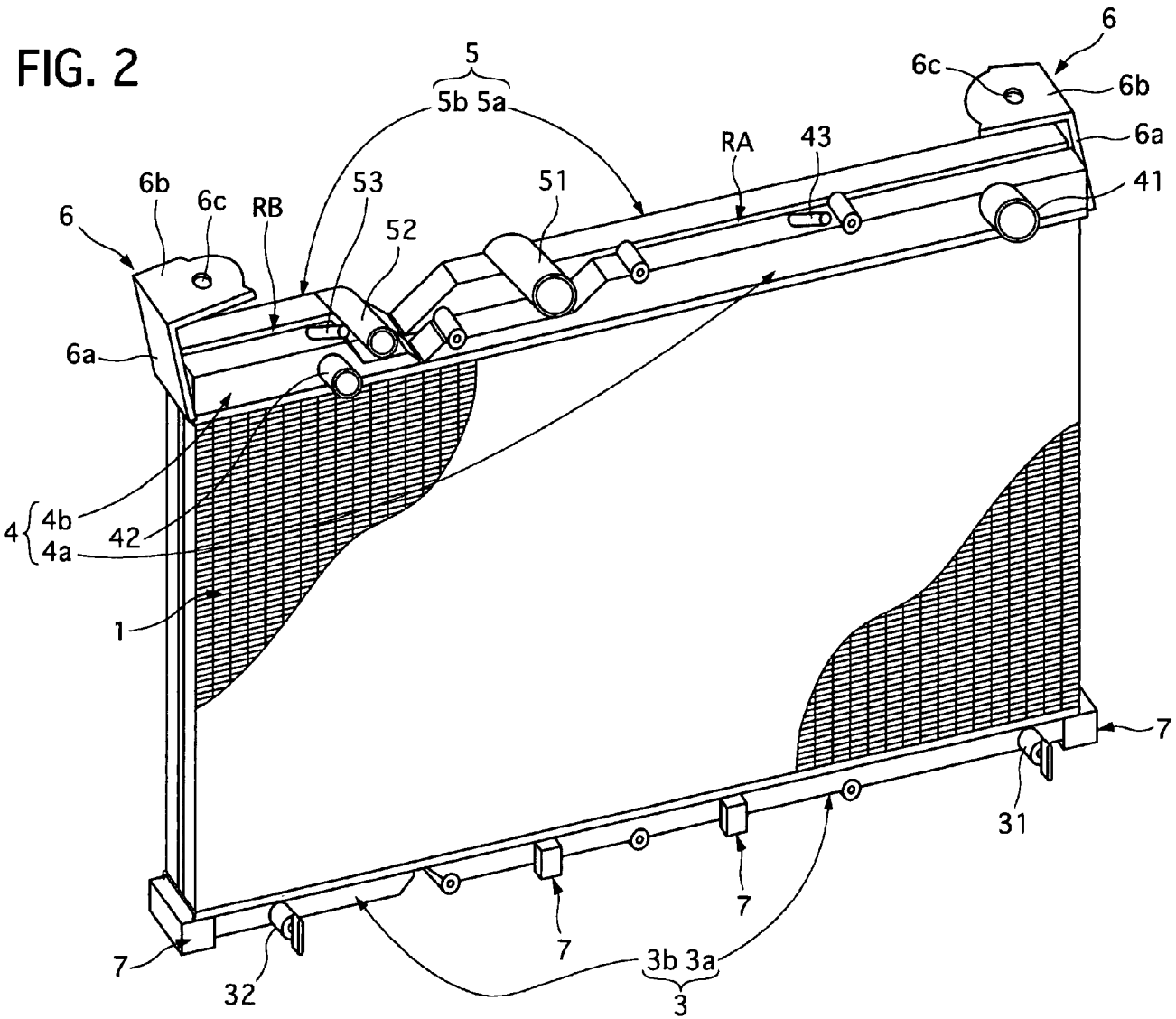
FIG. 2 is a perspective view showing the countercurrent heat exchanger of the embodiment shown in FIG. 1.
Figure 3:
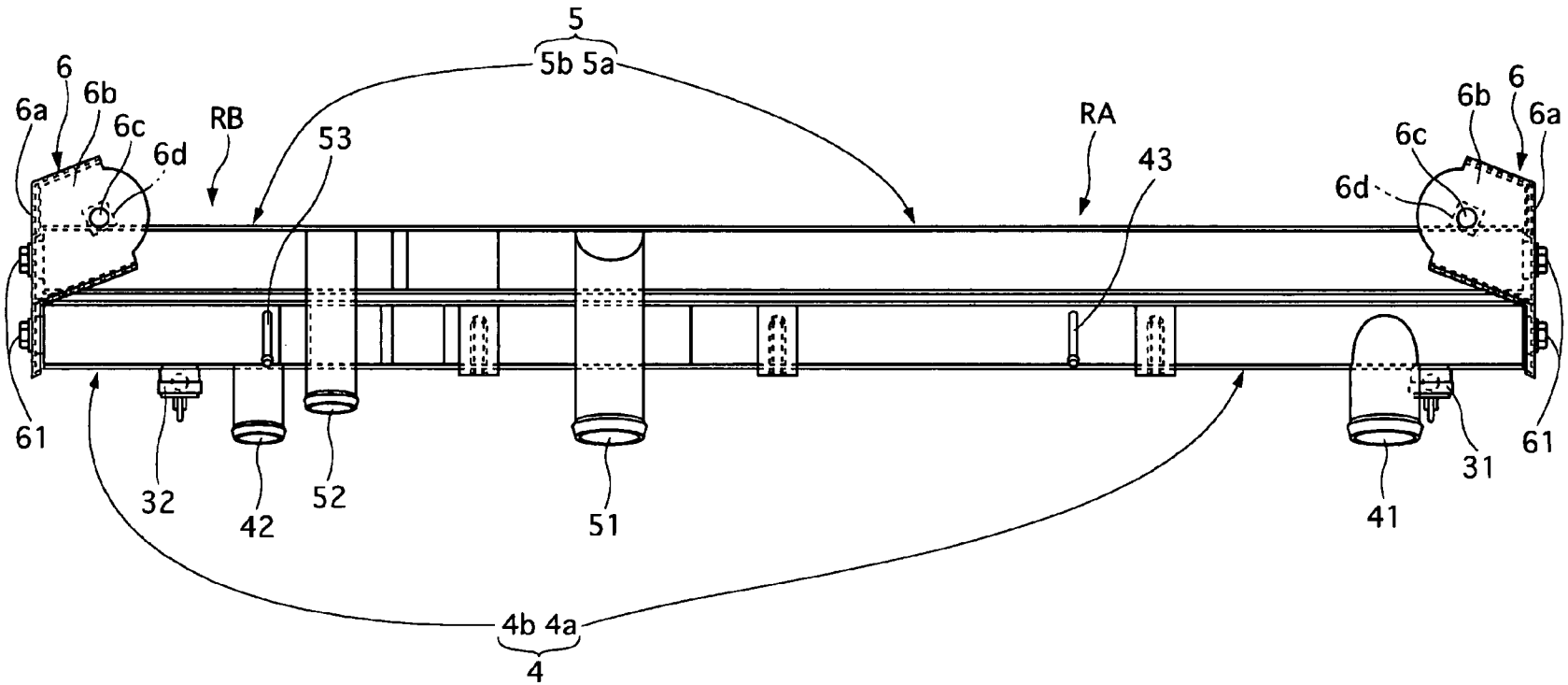
FIG. 3 is an enlarged plan view showing the countercurrent heat exchanger of the embodiment shown in FIG. 1.
Figure 4:
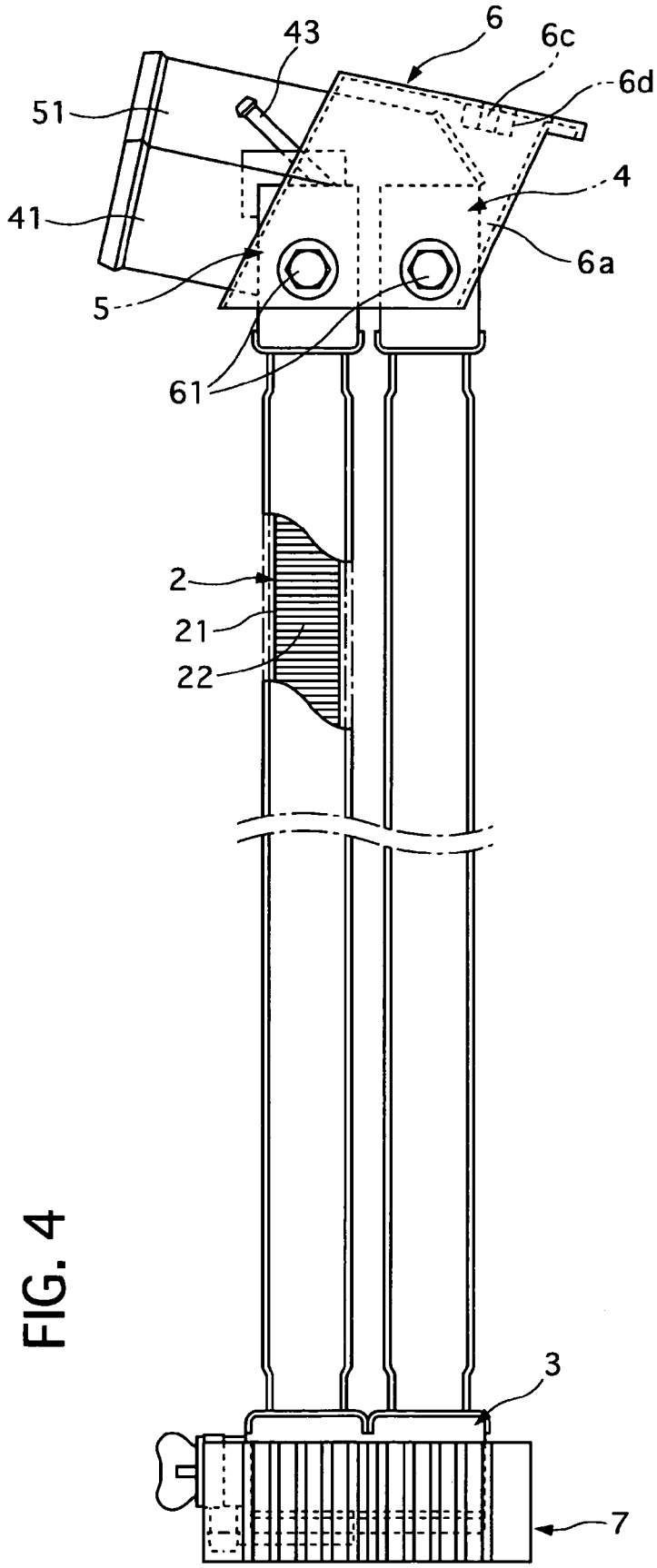
FIG. 4 is an enlarged and partially-sectional side view showing the countercurrent heat exchanger of the embodiment shown in FIG. 1.

FIG. 1 is a partially-sectional front view showing a countercurrent heat exchanger of the embodiment, FIG. 2 is a perspective view of the same, FIG. 3 is an enlarged plan view of the same, and FIG. 4 is an enlarged side view of the same.

The countercurrent heat exchanger of the embodiment includes an inflow-side heat exchanger core 1, an outflow-side heat exchanger core 2, a U-turn intermediate tank 3 connecting between the both heat exchanger cores 1 and 2, an inflow-side tank 4 connected with the inflow-side heat exchanger core 1, an outflow-side tank 5 connected with the outflow-side heat exchanger core 2, a bracket 6 for supporting the heat exchanger to a vehicle-body-side, and a rubber bush 7 for supporting the intermediate tank 3 to the vehicle-body-side. Incidentally, the rubber bush 7 corresponds to an elastically supporting member of the present invention.

The construction of the above-described countercurrent heat exchanger will be described in detail. The inflow-side heat exchanger core 1 and the outflow-side heat exchanger core 2 are constructed to have multiple tubes 11 and 21 in which the coolant flows and fins 12 and 22 which cools the coolant, being arranged alternatively in their lateral directions and the tubes being connected with one another. These both heat exchanger cores 1 and 2 are mounted on the vehicle body in a state in which they are disposed next to each other in their depth directions.

The both heat exchanger cores 1 and 2 are connected at lower end sides of the tubes 11 and 21 with the U-turn intermediate tank 3, respectively, and also connected at upper end sides of the tubes 11 and 21 with the inflow-side tank 4 and the outflow-side tank 5, which are separated from each other, respectively.

Two brackets 6 and 6 are used for attaching the inflow-side tank 4 and the outflow-side tank 5 to the radiator core support 8, and prepared for the both end portions in their longitudinal directions of the inflow-side tank 4 and the outflow-side tank 5. Incidentally, the radiator core support 8 corresponds to a vehicle body member of the present invention.

Specifically, these brackets 6 have heat-exchanger-side attachment portions 6*a*, which are attached to the both longitudinally directional end portions of the inflow-side tank 4 and the outflow-side tank 5 by bolts 61 and 61, respectively, so that the tanks 4 and 5 are rotatable around the center of the bolts 61 and 61. In addition, vehicle-body-side attachment portions 6*b* and 6*b* are formed to be bent, in a substantially horizontal direction and in a state where they extend toward each other, from the vertical heat-exchanger-side attachment portions 6*a* and 6*a*, respectively. They are also formed with bolt holes 6*c* and 6*c* for fixing them to a vehicle body side and provided with welded nuts 6*d* and 6*d* welded in advance on their under surface sides in accordance with the bolt holes 6*c* and 6*c*. Bolts 62 and 62 are inserted from a radiator core support 8 side and screwed into the welded nuts 6*d* and 6*d* through bushes, so that they fix the inflow-side tank 4 and the outflow-side tank 5 to the radiator core support 8 side.

On the other hand, the U-turn intermediate tank 3 is elastically supported on the radiator core support 8 through the plural rubber bushes 7 and 7, which are located on a lower portion of the U-turn intermediate tank 3.

Each inner portion of the inflow-side tank 4, the outflow-side tank 5 and the U-turn intermediate tank 3 is separated at a middle position in its longitudinal direction, and thereby producing a structure combining a first radiator RA with large capacity and a second radiator RB with small capacity integrally in their lateral directions.

First radiator RA side portions of the inflow-side tank 4*a* and the outflow-side tank 5*a* are connected with an inflow pipe 41 and an outflow pipe 51, respectively. Similarly, second radiator RB side portions of the inflow-side tank 4*a* and the outflow-side tank 5*a* are connected with an inflow pipe 42 and an outflow pipe 52, respectively. Incidentally, the inflow-side tanks 4*a* and 4*b* are provided with air-bleeding pipes 43 and 53, respectively, and the intermediate tanks 3*a* and 3*b* are provided with drain pipes 31 and 32, respectively.

In normal vehicles with an combustion engine, the first radiator RA with large capacity can be used for cooling engine coolant, and the second radiator RB with small capacity can be used for cooling electric system coolant. In case of a Fuel-Cell powered vehicle (FCV) using a Fan Coil Unit (FCU), the first radiator RA with large capacity can be used for cooling heater circuits of an air conditioner, fuel-cell stacks and others, and the second radiator RB with small capacity can be used for cooling an inverter, an electric motor, other circuits and the like provided in the Fuel-Cell powered vehicle (FCV) using Long Life Coolant (LLC).

Next, the operation and effects of the countercurrent heat exchanger of the embodiment will be described.

In the countercurrent heat exchanger constructed above, high-temperature coolants flowing through the inflow pipes 41 and 42 into the inner portions of the inflow-side tanks 4*a* and 4*b*, respectively, are cooled off in the first radiator RA and the second radiator RB while they flow in the tubes 11 and 11 of the inflow-side heat exchanger cores 1 and 1. Then, the coolants flow into the U-turn intermediate tanks 3*a* and 3*b*, from which the coolants flow into the outflow-side tanks 5*a* and 5*b*, being more cooled while they flow in the tubes 21 and 21 of the outflow-side heat exchanger cores 2 and 2, respectively. Then, they flow out of the outflow pipes 51 and 52.

A thermal expansion difference between the inflow-side heat exchanger cores 1 and 1 and the outflow-side heat core 2 and 2 becomes large, because the temperature difference at the first radiator RA side becomes fairly high, approximately 40° C. between the coolant flowing the inflow-side heat exchanger cores 1 and 1 connected with the inflow-side tanks 4*a* and 4*a* and the coolant flowing in the outflow-side heat exchanger cores 2 and 2 connected with the outflow-side tanks 5*a* and 5*b*, and that at the second radiator RB side becomes approximately 20° C. However, in the countercurrent heat exchanger of the embodiment, the inflow-side tank 4 and the outflow-side tank 5 are formed so that they are separated from each other, and the inflow-side tank 4 and the outflow-side tank 5 are supported at its both longitudinally-directional end portions so that they are rotatable around the bolts 61 and 61 by each using one bolt 61, 61 and the bracket 6, 6 in order to attach them to the radiator core support 8, the vehicle body side. This allows the brackets 6 and 6 to be rotated relatively to each other at the bolts 61 and 61 with respect to the inflow-side tanks 4*a* and 4*b* and the outflow-side tanks 5*a* and 5*b*, when the inflow-side heat exchanger core 1 and the outflow-side heat exchanger core 2 expand and contract in a vertical direction with respect to the U-turn intermediate tank 3 due to a temperature change, thereby causing an expansion and contraction difference between the both heat exchanger cores 1 and 2 due to their temperature difference. By this rotation, the expansion and contraction difference can be absorbed.

Further, the expansion and contraction in the vertical direction of the inflow-side heat exchanger core 1 and the outflow-side heat exchanger core 2 can be absorbed by using elasticity of the rubber bushes 7, since the U-turn intermediate tank 3 is constructed so that it is elastically supported by the radiator core support 8 through a plurality of rubber bushes 7 and 7.

Therefore, the countercurrent heat exchanger of the embodiment can provide an effect of preventing occurrence of the strain, the crack, the destruction and the like in any portion thereof due to thermal stress caused by the temperature difference between the coolant flowing in the inflow-side heat exchanger core 1 and the coolant flowing in the outflow-side heat exchanger core 2.

Further, heat in the coolant flowing in the inflow-side tank 4 can be prevented from its direct transfer to the outflow-side tank 5 and heating the coolant in the outflow side, because the inflow-side tank 4 and the outflow-side tank 5 are separated from each other. Accordingly, an effect on improving the heat transfer efficiency of the countercurrent heat exchanger can be obtained.

The corrugated fin feeding apparatus of the embodiment according to the present invention has been described above, but the specific structure of the present invention is not limited to this embodiment. The present invention includes any change of design in the range not departing from the gist of the invention.

Figure 5:
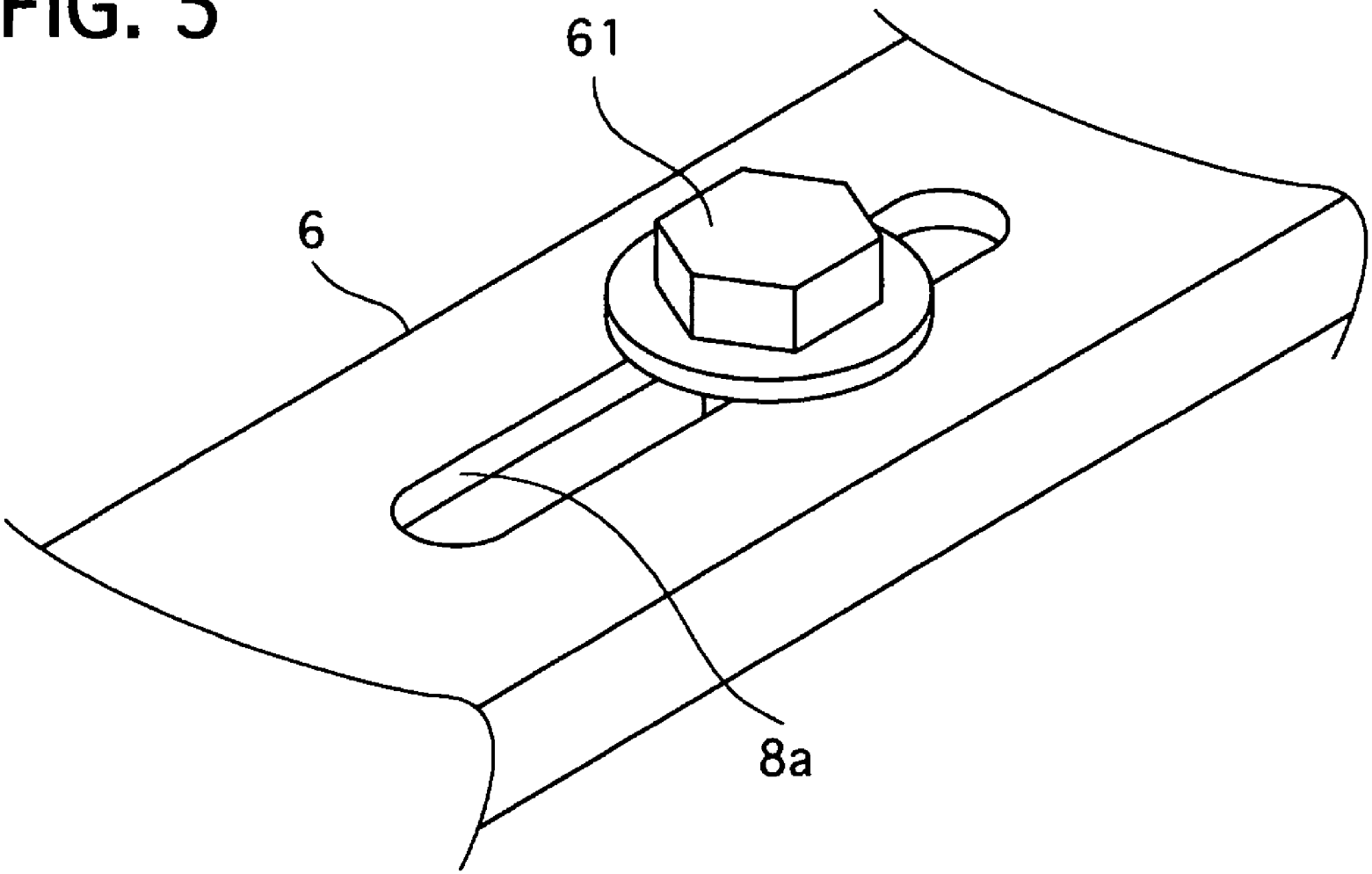
FIG. 5 is an enlarged fragmentary perspective view showing a modified peripheral portion of a bracket of the countercurrent heat exchanger shown in FIG. 1.

For, example, each of the brackets 6 and 6 is attached by one bolt 61, 61 rotatably around the bolts 61 and 61 in the above-described embodiment, but as shown in FIG. 5, a bolt through-hole at the bracket 6 side may be formed to be an elongate hole 8*a*, so that the inflow-side tanks 4*a* and 4*b* and the outflow-side tanks 5*a* and 5*b* can independently slide relative to the brackets 6. Incidentally, the bolts 61 and 61 and the brackets 6 and 6 may be used so that one of them are attached to the inflow-side tanks 4*a* and 4*b* and the outflow-side tanks 5*a* and 5*b* and the others are attached to the vehicle body side.

Further, although the inflow-side tank 4 and the outflow-side tank 5 are attached together to one bracket 6 in the embodiment, the they may be attached to independent brackets, respectively.

Further, although the rubber bushes 7 are used as an elastically supporting member for elastically supporting the U-turn intermediate tank 3 side in the above-described embodiment, they may be replaced by a leaf spring, a coil spring and the like.

Further, in the above-described embodiment, a construction is taken up as an example, in which the first radiator RA with large capacity and the second radiator RB with small capacity are formed integrally in their lateral directions with each other by separation of each inner portions of the inflow-side tank 4, the outflow-side tank 5 and the U-turn immediate tank 3 at the middle position in their longitudinal directions. But, they may be constructed and used as one entire radiator without the separation like this.

INDUSTRIAL APPLICABILITY

The countercurrent heat exchanger according to the present invention can be available to a heat exchanger for a motor vehicle and others such that it has a pair of heat exchangers arranged next to each other.

The invention claimed is:

1. A countercurrent heat exchanger, comprising:

a pair of heat exchanger cores having multiple tubes and fins which are arranged alternately, the heat changer cores being arranged next to each other in a depth direction thereof;

a U-turn intermediate tank connected with one end sides of the tubes contained in the heat exchanger cores;

an inflow-side tank connected with the other end sides of the tubes contained in one of the heat exchanger cores; and an outflow-side tank formed to be separated from the inflow-side tank, the outflow-side tank being connected with the other end sides of the tubes contained in the other of the heat exchanger cores, wherein the inflow-side tank, the outflow-side tank and the intermediate tank are attached to a vehicle body side, wherein the inflow-side tank and the outflow-side tank are attached to the vehicle body side through brackets and bolts which are set to allow a relative movement therebetween so that the both heat exchanger cores can expand and contract independently from each other with respect to the intermediate tank.

2. The countercurrent heat exchanger of claim 1, wherein the inflow-side tank and the outflow-side tank are provided at both end portions thereof with the brackets, and each of the brackets are attached to the vehicle body side by bolts so that the bracket can rotate around the bolts relative to both longitudinally-directional end portions of the inflow-side tank and the outflow-side tank.

3. The countercurrent heat exchanger of claim 1, wherein the inflow-side tank and the outflow-side tank are provided at both end portions thereof with the brackets, each of the brackets being formed with an elongate hole, and the inflow-side tank and the outflow tank are attached to the vehicle body side by inserting the bolt into the elongate hole so that the inflow-side tank and the outflow tank can move relative to the vehicle body side.

4. The countercurrent heat exchanger of claim 1, wherein the intermediate tank is mounted on the vehicle body side through an elastically supporting member.

5. The countercurrent heat exchanger of claim 2, wherein the intermediate tank is mounted on the vehicle body side through an elastically supporting member.

6. The countercurrent heat exchanger of claim 3, wherein the intermediate tank is mounted on the vehicle body side through an elastically supporting member.

7. The countercurrent heat exchanger of claim 1, wherein the brackets are configured to permit the inflow-side tank and the outflow-side tank to rotate relative to one another.

8. The countercurrent heat exchanger of claim 1, wherein the brackets are configured to rotate relative to each other at the bolts.

9. The countercurrent heat exchanger of claim 1, wherein the brackets comprise independent brackets for each of the inflow-side tank and the outflow-side tank.

10. A countercurrent heat exchanger, comprising:

a pair of heat exchanger cores having multiple tubes and fins which are arranged alternately, the heat changer cores being arranged next to each other in a depth direction thereof;

a U-turn intermediate tank connected with one end sides of the tubes contained in the heat exchanger cores;

an inflow-side tank connected with the other end sides of the tubes contained in one of the heat exchanger cores; and an outflow-side tank formed to be separated from the inflow-side tank, the outflow-side tank being connected with the other end sides of the tubes contained in the other of the heat exchanger cores, wherein the inflow-side tank, the outflow-side tank and the intermediate tank are attached to a vehicle body side so that the both heat exchanger cores can expand and contract independently from each other with respect to the intermediate tank;

wherein the inflow-side tank and the outflow-side tank are provided at both end portions thereof with brackets for attaching the inflow-side tank and the outflow-side tank to the vehicle body side, wherein each of the brackets are attached to the vehicle body side by bolts so that the bracket can rotate around the bolts relative to both longitudinally-directional end portions of the inflow-side tank and the outflow-side tank.

11. A countercurrent heat exchanger, comprising:

a pair of heat exchanger cores having multiple tubes and fins which are arranged alternately, the heat changer cores being arranged next to each other in a depth direction thereof;

a U-turn intermediate tank connected with one end sides of the tubes contained in the heat exchanger cores;

an inflow-side tank connected with the other end sides of the tubes contained in one of the heat exchanger cores; and an outflow-side tank formed to be separated from the inflow-side tank, the outflow-side tank being connected with the other end sides of the tubes contained in the other of the heat exchanger cores, wherein the inflow-side tank, the outflow-side tank and the intermediate tank are attached to a vehicle body side so that the both heat exchanger cores can expand and contract independently from each other with respect to the intermediate tank;

the inflow-side tank and the outflow-side tank are provided at both end portions thereof with brackets for attaching the inflow-side tank and the outflow-side tank to the vehicle body side, each of the brackets being formed with an elongate hole, wherein the inflow-side tank and the outflow tank are attached to the vehicle body side by inserting a bolt into the elongate hole so that the inflow-side tank and the outflow tank can move relative to the vehicle body side.

* * * * *